United States Patent [19]

Schwarz

[11] 4,102,305

[45] Jul. 25, 1978

[54] DEVELOPMENT SYSTEM WITH ELECTRICAL FIELD GENERATING MEANS

[75] Inventor: William M. Schwarz, Webster, N.Y.

[73] Assignee: Xerox Corporation, Stamford, Conn.

[21] Appl. No.: 812,216

[22] Filed: Jul. 1, 1977

[51] Int. Cl.[2] ..... G03G 15/09

[52] U.S. Cl. ..... 118/651; 118/658

[58] Field of Search ..... 118/651, 657, 658, 647; 96/1 C, 1 R (U.S. only); 346/153, 160

[56] References Cited

U.S. PATENT DOCUMENTS

| | | | |
|---|---|---|---|
| 3,262,803 | 7/1966 | Gourge | 118/657 |
| 3,328,193 | 6/1967 | Oliphant | 118/651 X |
| 3,455,276 | 7/1969 | Anderson | 118/658 |
| 3,563,734 | 2/1971 | Shely | 118/651 |
| 3,654,893 | 4/1972 | Piper et al. | 118/651 |
| 3,674,532 | 7/1972 | Morse | 118/657 |
| 3,754,526 | 8/1973 | Caudill | 118/658 |
| 3,816,840 | 6/1974 | Kotz | 96/1 R |
| 3,866,574 | 2/1975 | Hardennrook et al. | 118/651 X |
| 3,914,771 | 10/1975 | Lunde | 346/160 |
| 4,036,175 | 7/1977 | Phillips et al. | 118/651 |
| 4,039,257 | 8/1977 | Connolly | 96/1 C X |

*Primary Examiner*—Louis K. Rimrodt
*Assistant Examiner*—Andrew M. Falik
*Attorney, Agent, or Firm*—J. J. Ralabate; C. A. Green; H. Fleischer

[57] ABSTRACT

An apparatus in which a latent image is developed with particles having the resistivity thereof varying as a function of the electrical field applied thereto. The electrical field generated during development is of sufficient magnitude to render the particles substantially conductive.

14 Claims, 3 Drawing Figures

DEVELOPMENT SYSTEM WITH ELECTRICAL FIELD GENERATING MEANS

The foregoing abstract is neither intended to define the invention disclosed in the specification, nor is it intended to be limiting as to the scope of the invention in any way.

BACKGROUND OF THE INVENTION

This invention relates generally to an electrostatographic printing machine, and more particularly concerns an improved development system for use therein.

An electrostatographic printing process forms an electrostatic latent image and reproduces the image in viewable form on a copy sheet. The field of electrostatography includes electrophotography and electrography. Electrophotography employs a photosensitive medium to form, with the aid of electromagnetic radiation, the electrostatic latent image. Electrography utilizes an insulating medium to form, without the aid of electromagnetic radiation, the electrostatic latent image. In both of the foregoing processes, the latent image is rendered viewable by the process of developing, i.e. depositing particles thereon. Frequently, the particles are transferred from the latent image to a copy sheet. In some processes, the recording sheet on which the latent image is produced, may also serve as the copy sheet after the particles have been deposited thereon. However, in either case, the resultant toner powder image deposited on the sheet is permanently affixed thereto by applying heat and/or pressure. Hereinafter, an electrophotographic printing machine will be described as an illustrative embodiment of these processes.

In electrophotographic printing, the photoconductive member is charged to sensitize its surface. The charged photoconductive member is exposed to a light image of the original document being reproduced. Exposure of the sensitized photoconductive surface discharges the charge selectively. This records an electrostatic latent image on the photoconductive surface corresponding to the informational areas contained within the original document being reproduced. Development of the electrostatic latent image recorded on the photoconductive surface is achieved by bringing developer material into contact therewith. Typical developer materials comprise dyed or colored heat settable plastic powders, known in the art as toner particles, which are mixed with coarser carrier granules, such as ferromagnetic granules. The toner particles and carrier granules are selected such that the toner particles acquire the appropriate charge relative to the electrostatic latent image recorded on the photoconductive surface. Thus, when developer material is brought into contact with the latent image recorded on the photoconductive surface, the greater attractive force thereof causes the toner particles to transfer from the carrier granules and adhere to the electrostatic latent image. This concept was originally disclosed by Carlson in U.S. Pat. No. 2,297,691 and is further amplified and described by many related patents in the art.

Various methods have been developed for applying the developer material to the latent image. For example, the developer material may be cascaded over the latent image and the toner particles attracted from the carrier granules thereto. Other apparatus employed to develop the latent image include the use of magnetic field producing devices which form brush-like tufts extending outwardly therefrom contacting the photoconductive surface.

With the advent of single component developer i.e. conductive particles, carrier granules are no longer required. U.S. Pat. No. 2,846,333 issued to Wilson in 1956 describes a typical single component developer material. In general, the charged particles employed with the single component developer material have low resistivities which range from about $10^4$ to about $10^9$ ohm-cm. These particles are developed on the latent image. However, when the particles are transferred from the photoconductive surface to the copy sheet, repulsion frequently occurs. Transfer is optimized by employing particles having higher resistivities. Contrawise, development is optimized by utilizing particles having low resistivity or good conductivity. Thus, the system is faced with two contradictory requirements, i.e. particles having low resistivity for optimum development and high resistivity for optimum transfer.

Accordingly, it is a primary object of this invention to improve the development system employed in an electrophotographic printing machine so as to optimize both development and transfer.

PRIOR ART STATEMENT

Various types of devices have hereinbefore been developed to improve the development system of an electrophotographic printing machine. The following prior art appears to be relevant; Gourge, U.S. Pat. No. 3,262,806, 7/26/66; Anderson, U.S. Pat. No. 3,455,276, 7/15/69; Shely, U.S. Pat. No. 3,563,734, 8/28/67; Piper et al, U.S. Pat. No. 3,654,893, 4/11/72; Morse, U.S. Pat. No. 3,674,532, 7/4/72; Caudill, U.S. Pat. No. 3,754,526, 8/28/73; Kotz, U.S. Pat. No. 3,816,840, 6/11/74; Lunde et al, U.S. Pat. No. 3,914,771, 10/21/75.

The pertinent portions of the foregoing prior art may be briefly summarized as follows:

Gourge discloses a DC bias magnetic brush roller.

Anderson describes the sleeves of an applicating roller connected to a source of potential.

Shely teaches a magnetic brush developer unit employing single component conductive particles. A unidirectional potential source is connected to a conductive roller having the particles adhering thereto.

Piper et al discloses a control system for regulating a voltage supply by a single magnetic brush.

Morse also discloses a system for electrically biasing a magnetic brush during development to a voltage initially insensed by the brush.

Caudill teaches a potential source connected to a cylindrical member of the magnetic brush biasing it to a fixed potential.

Kotz describes the developer roll having a cylindrical magnetic support with cylindrical permanent magnetic sectors secured thereto. A cylindrical conducting nonmagnetic shell is interfit telescopically over the magnetic sectors. Magnetically attractable, electronically conducting toner is metered onto the surface of the shell. The shell is connected to a source of electrical potential.

Lunde et al describes a developer roll having a nonmagnetic outer cylindrical shell telescoped over a magnetic roller. Electronically conducting toner is metered onto the surface of the shell. A pulse control circuit is coupled to the shell and applies a voltage pulse when one of the magnetic sectors of the roller is in an optimum position for development.

It is believed that the scope of the present invention, as defined by the appended claims, is clearly patentably distinguishable over the foregoing prior art taken either singly or in combination with one another.

SUMMARY OF THE INVENTION

Briefly stated, and in accordance with the present invention, there is provided an apparatus for developing a latent image with particles having the resistivity thereof varying as a function of the electrical field applied thereto.

Pursuant to the features of the present invention, means deposit the particles on the latent image. Means are provided for generating an electrical field between the latent image and the depositing means. The electrical field is of sufficient magnitude to render the particles substantially conductive.

BRIEF DESCRIPTION OF THE DRAWING

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
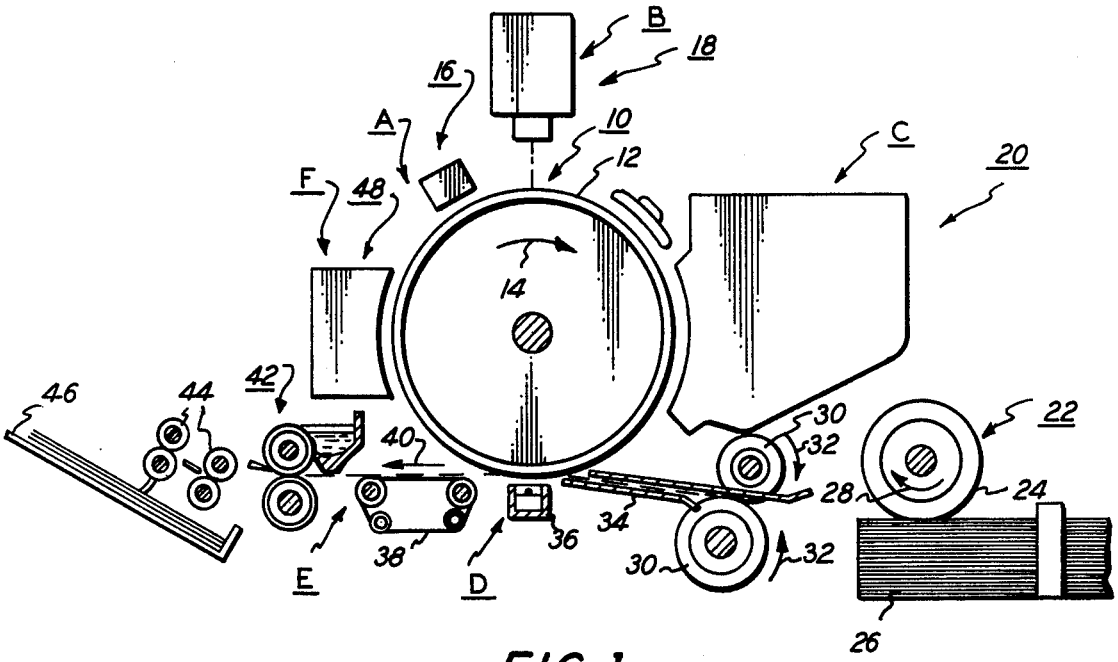
FIG. 1 is a schematic elevational view depicting an electrophotographic printing machine incorporating the features of the present invention therein.

For a general understanding of an electrophotographic printing machine in which the features of the present invention may be incorporated, reference is had to FIG. 1 which depicts schematically the various components thereof. Hereinafter, like reference numerals will be employed throughout to designate identical elements. Although the development apparatus is particularly well adapted for use in electrophotographic printing, it should become evident from the following discussion that it is equally well suited for use in a wide variety of devices and is not necessarily limited in its application to the particular embodiment shown herein.

Inasmuch as the practice of electrophotographic printing is well known in the art, the various processing stations for producing a copy of an original document are represented in FIG. 1 schematically. Each processing station will be discussed briefly hereinafter.

As in all electrophotographic systems of the type illustrated, a drum 10 having photoconductive surface 12 entrained about and secured to the exterior circumferential surface of a conductive substrate is rotated, in the direction of arrow 14, through the various processing stations. One type of suitable photoconductive material is described in U.S. Pat. No. 2,970,906 issued to Bixby in 1961. Preferably, the conductive substrate is made from aluminum.

Initially, drum 10 rotates a portion of photoconductive surface 12 through charging station A. Preferably, charging station A utilizes a corona generating device, indicated generally by the reference numeral 16, to sensitize photoconductive surface 12. Corona generating device 16 is positioned closely adjacent to photoconductive surface 12. When energized, corona generating device 16 charges at least a portion of photoconductive surface 12 to a relatively high substantially uniform potential. For example, corona generating device 16 may be of the type described in U.S. Pat. No. 2,836,725 issued to Vyverberg in 1958.

Thereafter, drum 10 rotates the charged portion of photoconductive surface 12 to exposure station B. Exposure station B includes an exposure mechanism, indicated generally by the reference numeral 18, having a stationary, transparent platen, such as a glass plate or the like, for supporting an original document thereon. Scan lamps illuminate the original document. Scanning of the original document may be achieved by oscillating a mirror in a timed relationship with the movement of drum 10. This mirror is positioned beneath the platen to reflect the light image of the original document through a lens onto a mirror, which, in turn, transmits the light image through an apertured slit onto the charged portion of photoconductive surface 12. Irradiating the charged portion of photoconductive surface 12 selectively discharges the charge thereon to record an electrostatic latent image corresponding to the informational areas contained within the original document.

Drum 10 next rotates the electrostatic latent image recorded on photoconductive surface 12 to development station C. Development station C includes a developer unit, indicated generally by the reference numeral 20, having a housing with a supply of particles contained therein. The particles have the resistivity thereof varying as a function of the electrical field applied thereto. Under high electrical fields, the particles are substantially conductive, whereas under low or no electrical fields, the particles are resistive. Developer unit 20 is a magnetic brush type of development system. In a system of this type, the particles are brought through a directional flux field to form a brush thereof. The electrostatic latent image recorded on photoconductive surface 12 is developed by bringing the brush of particles into contact therewith. During development, a high electrical field is generated rendering the particles substantially conductive. In this manner, the particles are attracted readily to the latent image forming a powder image on photoconductive surface 12. The detailed structure of developer unit 20 will be described hereinafter with reference to FIG. 2.

With continued reference to FIG. 1, a sheet of support material is advanced by sheet feeding apparatus 22 to transfer station D. Sheet feeding apparatus 22 includes a feed roll 24 contacting the uppermost sheet of the stack of sheets of support material 26. Feed roll 24 rotates in the direction of arrow 28 so as to advance the uppermost sheet from stack 26. Registration rollers 30, rotating in the direction of arrow 32, align and forward the advancing sheet of support material into chute 34. Chute 34 directs the advancing sheet of support material into contact with drum 10 in a timed sequence so that the powder image developed thereon contacts the advancing sheet of support material at transfer station D.

At transfer station D, corona generating device 36 applies a spray of ions to the backside of the sheet of support material. This attracts the powder image from photoconductive surface 12 to the sheet of support material. Corona generator 36 is located remotely from developer unit 20 so that the particles are unaffected by the high electrical field produced by developer unit 20. Thus, at transfer station D, the particles return to their normally resistive state optimizing transfer. After transfer, the sheet is separated from photoconductive surface 12 and advanced by conveyor 38 in the direction of arrow 40 to fusing station E.

Fusing station E includes a fuser assembly, indicated generally by the reference numeral 42. Fuser assembly 42 permanently affixes the transferred toner powder image to the sheet of support material. After the toner powder image is permanently affixed to the sheet of support material, the sheet of support material is advanced by a series of rollers 44 to catch tray 46 for subsequent removal therefrom by the machine operator.

Invariably, after the sheet of support material is stripped from photoconductive surface 12 of drum 10, some residual particles remain adhering to photoconductive surface 12. These residual particles are removed from photoconductive surface 12 at cleaning station F. Cleaning station F includes a cleaning system, indicated generally by the reference numeral 48. The particles are cleaned from photoconductive surface 12 by a rotatably mounted fibrous brush in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the specific subject matter of the present invention, FIG. 2 depicts developer unit 20 in greater detail.

Figure 2:
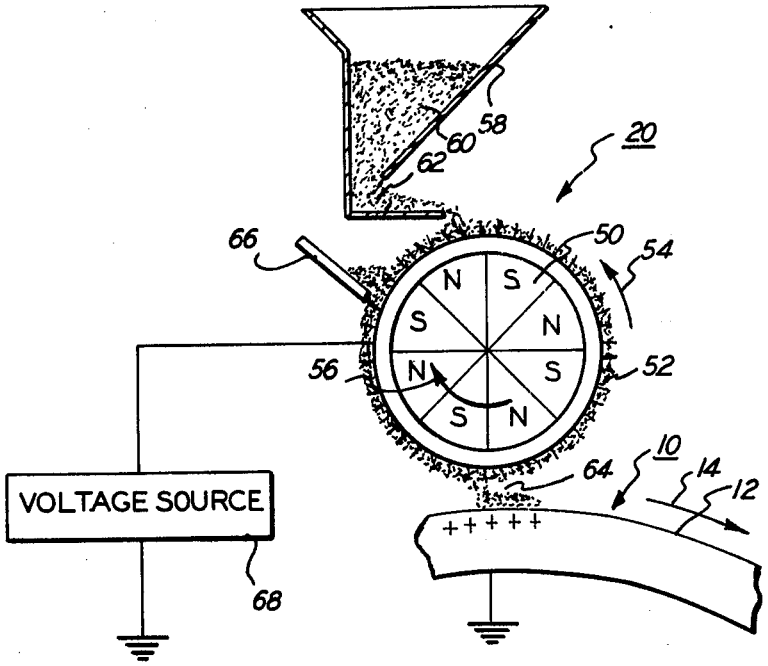
FIG. 2 is a schematic elevational view showing a development system employed in the FIG. 1 printing machine.

Turning now to FIG. 2, there is shown the detailed structure of developer unit 20. As depicted thereon, developer unit 20 comprises a magnetic rotor 50 having a plurality of magnetic poles impressed about the circumferential surface thereof. Magnetic rotor 50 is cylindrical. A non-magnetic tubular member 52 is interfit telescopically over magnetic rotor 50. Preferably, magnetic rotor 50 is made from barium ferrite while tubular member 52 is made from aluminum having the exterior circumferential surface thereof roughened. In one embodiment, tubular member 52 rotates in the direction of arrow 54 while magnetic rotor 50 remains stationary. Alternatively, tubular member 52 may remain stationary while magnetic rotor 50 rotates in the direction of arrow 56. Tubular member 52 is positioned closely adjacent to photoconductive surface 12. The gap 64 between the exterior circumferential surface of tubular member 52 and photoconductive surface 12 is about 25 mils.

Hopper 58 stores a supply of particles 60 therein. The particles are dispensed through opening 62 onto the surface of tubular member 52. Preferably, particles 60 are conductive and magnetic. Thus, particles 60 are attracted by magnetic rotor 50 to the roughened exterior surface of tubular member 52. By way of example, if tubular member 52 rotates in the direction of arrow 54, the particles adhering to the surface thereof move therewith. Contrawise, if tubular member 52 remains stationary and magnetic rotor 50 rotates in the direction of arrow 56, the particles advance with the rotating magnetic field into the development zone or the gap 64 between photoconductive surface 12 and tubular member 52. Metering blade 66 regulates the quantity of particles disposed on tubular member 52.

Voltage source 68 electrically biases tubular member 52 with an AC voltage so as to generate an alternating field between photoconductive surface 12 and tubular member 52. By way of example, voltage source 66 may apply a peak AC voltage ranging from about 20 to about 100 volts per micron of gap 64 between tubular member 52 and photoconductive surface 12. The AC voltage is applied at a frequency ranging from about 500 to about 5,000 hertz. The frequency must be high relative to the time that the particles spend in the development zone in order to avoid strobe line. However, this frequency must not be too high which avoids particle charging. In practice, frequencies ranging from about 500 to about 5,000 hertz satisfy these criteria when the tangential velocity of drum 10 is about 10 inches per second. Very often it is desirable to superimpose the AC voltage over a DC voltage. Thus, voltage source 68 may apply a DC voltage of about 1 volt per micron of gap 64 well as the alternating voltage having a peak value of 20 to 100 volts per micron of gap 64.

When tubular member 52 rotates, voltage source 68 is coupled to tubular member 52 by a commutator and brush assembly. Alternatively, when tubular member 52 is stationary, it is directly connected thereto.

In lieu of electrically coupling voltage source 68 to tubular member 52, voltage source 68 may apply an AC voltage to drum 10 so as to establish an alternating field in the gap between tubular member 52 and photoconductive surface 12.

Figure 3:
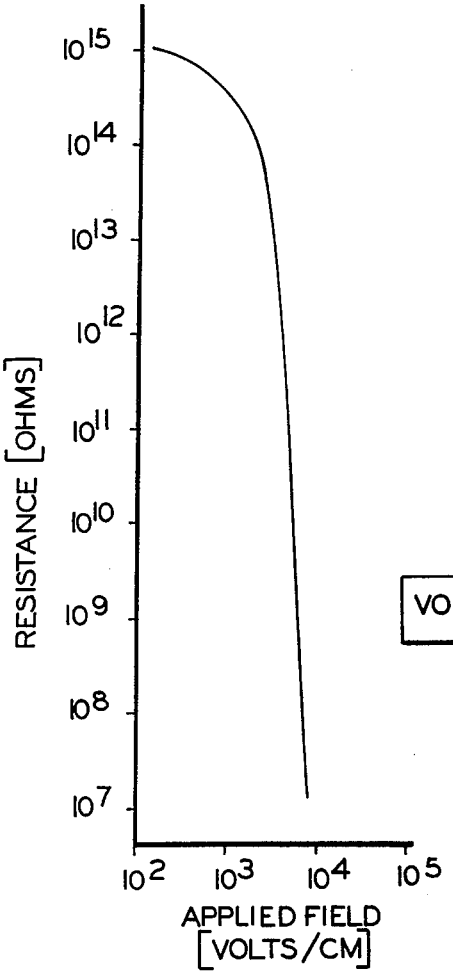
FIG. 3 is a graph depicting the change in resistivity of the particles employed in the FIG. 2 development system.

Referring now to FIG. 3, one type of suitable particle is a spray dried material containing 50 percent by weight of magnetite manufactured by Pfizer, Inc. of New York, under the tradename MO4431. This type of magnetite is coated with a stearate composition. The spray-dried material also contains 50 percent by weight of a copolymer of 65 percent styrene and 35 percent n-butyl methacrylate. The electrical characteristics of this material are depicted in FIG. 3.

As shown in FIG. 3, the resistivity of the particles remain substantially constant from 100 volts per centimeter to about 1100 volts per centimeter. Between 1100 volts per centimeter and 10,000 volts per centimeter, the resistivity decreases from about $10^{14}$ ohms to about $10^{7}$ ohms. Thus, the resistivity of the material remains substantially high when a low or no electrical field is applied thereto. However, when a high electrical field is applied thereto, the resistivity decreases markedly and the particles may be considered conductive. Thus, in the development zone, the high electrical field applied to the particles renders them substantially conductive. However, as the particles move away from the development zone and into the transfer zone, the high electrical field is no longer present. The particles then return to their normally resistive condition. In this manner, the particles are maintained conductive during development and resistive during transfer. This optimizes both the development process and the transfer process.

In recapitulation, it is evident that the apparatus of the present invention applies a high alternating field to particles being deposited on a latent image so as to render the particles substantially conductive during development. As the particles advance from the development zone, they return to their normally resistive condition. In this manner, the particles are resistive during transfer from the latent image to the copy sheet. This insures that both the development process and the transfer process are substantially optimized for single component developer materials.

It is, therefore, evident that there has been provided, in accordance with the present invention, a development system that fully satisfies the objects, aims, and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for developing a latent image with particles having the resistivity thereof varying as a function of the electrical field applied thereto, including:

means for depositing the particles on the latent image; and means for generating an electrical field between the latent image and said depositing means, said generating means forming a constant electrical field with an alternating electrical field superimposed thereover with the alternating electrical field having a peak amplitude sufficient to render the particles substantially conductive.

2. An apparatus as recited in claim 1, wherein said depositing means includes:

a magnetic member; and a non-magnetic tubular member interposed telescopically over said magnetic member and being spaced from the latent image to define a gap therebetween.

3. An apparatus as recited in claim 2, wherein said generating means includes a voltage source.

4. An apparatus as recited in claim 3, wherein said voltage source applies a peak voltage ranging from about 20 to about 100 volts per micron of gap.

5. An apparatus as recited in claim 4, wherein said voltage source applies an alternating voltage having a frequency ranging from about 500 hertz to about 5,000 hertz.

6. An apparatus as recited in claim 3, wherein said voltage source is electrically coupled to said tubular member.

7. An electrophotographic printing machine of the type having an electrostatic latent image recorded on a photoconductive member, wherein the improvement includes:

means for depositing particles having the resistivity thereof varying as a function of the electrical field applied thereto on the latent image; and means for generating an electrical field between the photoconductive member and said depositing means, said generating means forming a constant electrical field with an alternating electrical field superimposed thereover with the alternating electrical field having a peak amplitude sufficient to render the particles substantially conductive.

8. A printing machine as recited in claim 7, wherein said depositing means includes:

a magnetic member; and a non-magnetic tubular member interposed telescopically over said magnetic member and being spaced from the latent image recorded on the photoconductive member to define a gap therebetween.

9. A printing machine as recited in claim 8, wherein said generating means includes a voltage source.

10. A printing machine as recited in claim 8, wherein said voltage source applies a peak voltage ranging from about 20 to about 100 volts per micron of gap.

11. A printing machine as recited in claim 10, wherein said voltage source applies an alternating voltage having a frequency ranging from about 500 hertz to about 5,000 hertz.

12. A printing machine as recited in claim 9, wherein said voltage source is electrically coupled to said tubular member.

13. A printing machine as recited in claim 7, further including means, positioned remotely from said generating means, for transferring the particles from the latent image recorded on the photoconductive member to a sheet of support material, said transferring means being sufficiently remote from said generating means so that the particles are substantially resistive.

14. A printing machine as recited in claim 13, further including means for substantially permanently affixing the particles to the sheet of support material.

* * * * *